US005529077A

United States Patent [19]

Lidman

[11] Patent Number: 5,529,077

[45] Date of Patent: Jun. 25, 1996

[54] CIGAR WRAPPING DEVICE

[75] Inventor: Gösta Lidman, Kalmar, Sweden

[73] Assignee: PMB Holding B.V., Eindhoven, Netherlands

[21] Appl. No.: 244,106

[22] PCT Filed: Nov. 19, 1991

[86] PCT No.: PCT/SE91/00784

§ 371 Date: Jul. 18, 1994

§ 102(e) Date: Jul. 18, 1994

[87] PCT Pub. No.: WO93/09685

PCT Pub. Date: May 27, 1993

[51] Int. Cl.[6] ..... A24C 1/26

[52] U.S. Cl. ..... 131/105; 131/32; 131/58; 131/59

[58] Field of Search ..... 131/32, 58, 59, 131/105

[56] References Cited

U.S. PATENT DOCUMENTS 4,236,536 12/1980 Waegaert ..... 131/58 X

FOREIGN PATENT DOCUMENTS 0038889 11/1981 European Pat. Off. .

0053643 6/1982 European Pat. Off. .

0194670 9/1986 European Pat. Off. .

*Primary Examiner*—Jennifer Bahr

*Attorney, Agent, or Firm*—Young & Thompson

[57] ABSTRACT

A device for rolling wrappers onto cigar bodies, includes a lower roll unit (10) with a first pair of parallel rolls (14, 16) lying in a horizontal plane and rotatable in the same direction about their own axes for supporting contact with a lower half of a cigar body when a wrapper is rolled thereon. The rolls are mounted in a holder (22) at either end of the rolls. An upper roll unit (12) has two parallel rolls (46, 48) rotatable in the same direction about their own axes, and which, when the wrapper is rolled on, are disposed in a horizontal plane above and parallel to the rolls in the lower roll unit (10) in counteracting contact against an upper half of a cigar body. The lower roll unit (10) includes at least two additional rolls (18, 20), which are mounted in the same holders (22) as the first pair of rolls (14, 16) in the lower roll unit, and rotatable about their own axes in the same direction as the first pair. The holders (22) are rotatable about their central axis in 90° steps to always present two of its rolls in an upper position beside each other. The upper and lower roll units (10, 12) are movable toward and away from each other.

9 Claims, 2 Drawing Sheets

CIGAR WRAPPING DEVICE

Figures 1A, 1B, 1C, 1D, 1E, 1F:
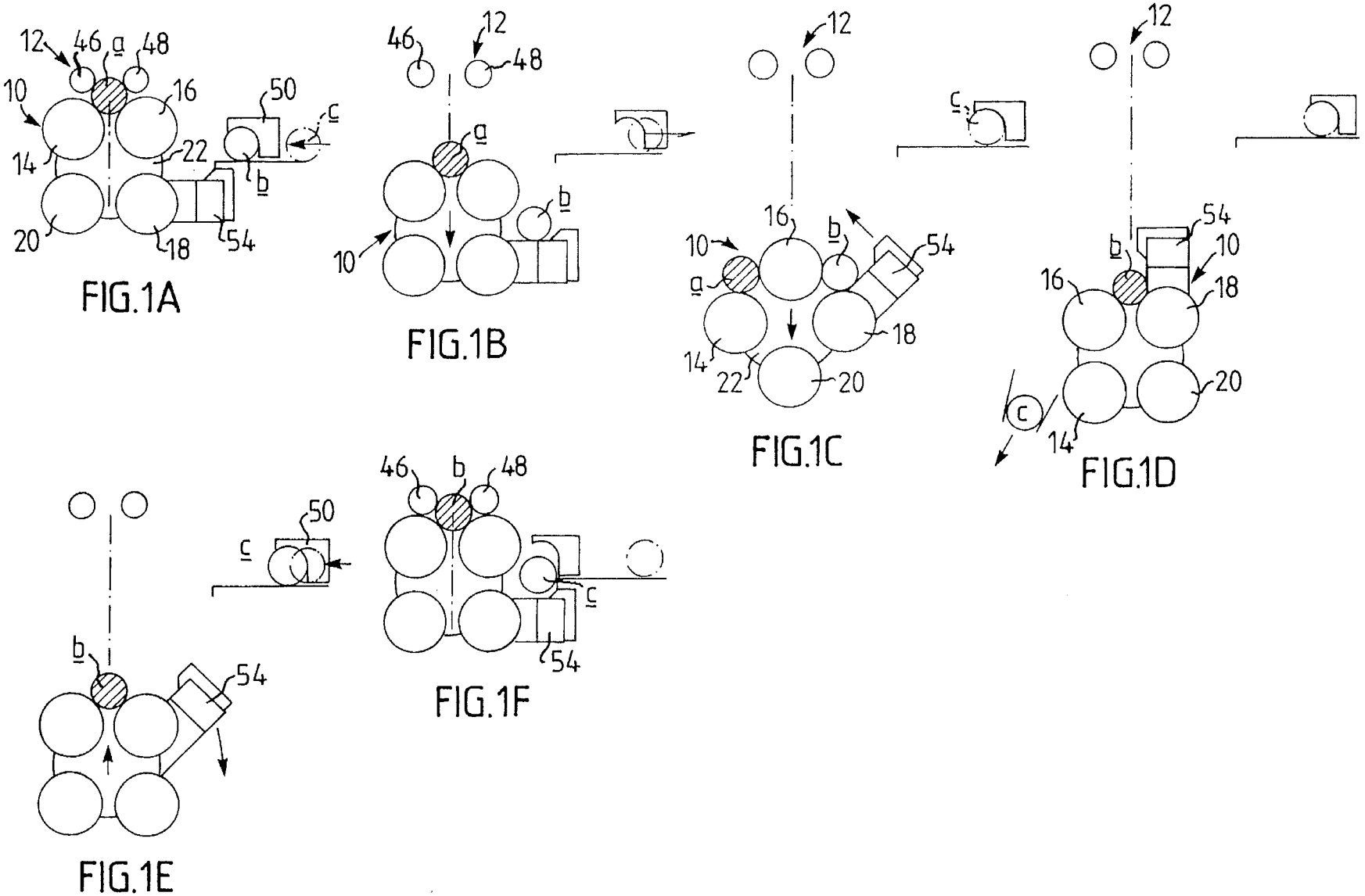

The present invention relates to a device for rolling wrappers onto cigar bodies, comprising, on one hand, a lower roll unit with a pair of rolls with parallel rolls lying in a horizontal plane and rotatable in the same direction for supporting contact with the lower half of a cigar body when a wrapper is rolled thereon, said rolls being mounted in a holder at either end of the rolls and, on the other hand, an upper roll unit with two parallel rolls rotatable in the same direction about their own axes, and which, when rolling on the wrapper, are disposed in a horizontal plane above and parallel to the rolls in the lower roll unit for counteracting contact against the upper half of the cigar body.

A device of this type is previously known and has been used for decades with high reliability for wrapping cigar bodies with wrappers producing cigars of high quality. In such a device, a cigar body is picked up from a feeding conveyor by means of a gripper which moves back and forth transporting the body and depositing it between the lower pair of rolls and thereafter returning to its pick-up station. The upper pair of rolls is thereafter moved from a retracted position to rolling contact with the top of the cigar body, whereafter a vacuum conveyor delivers a wrapper above the roll apparatus by a so-called wrapper-needle pressing one end of the wrapper against one end of the cigar body. After completed rolling of the wrapper above the cigar body, another conveyor picks up the finished wrapped cigar and places it on an exit conveyor.

One disadvantage of this device is that the productivity is relatively limited, since only about 30 bodies can be wrapped per minute.

One purpose of the present invention is to improve the productivity of a rolling apparatus of the type in question while retaining the otherwise good rolling properties of the previously known device. In order to solve this problem, it is suggested in accordance with the present invention that the lower roll unit comprises at least two additional rolls which are mounted in the same holder as the two other rolls in the lower roll unit and rotatable about their own axes in the same direction as these, that the holders be rotatable about their centre axis in 90° steps to always present two of its rolls in an upper position beside each other, and that the upper and lower roll units be moveable towards and away from each other. By disposing the four rolls in this manner in the lower roll unit, the holder of which can be rotated in 90° increments, a finished cigar will fall out of the rolling apparatus by its own weight at the same instant as a new subsequent cigar body is brought to the wrapping station by the two rolls, which, after the 90° rotation of the holders, become the active lower rolls in the rolling apparatus. Thus the productivity of the rolling apparatus can be doubled, i.e. about 60 cigars per minute.

Further significant features of the invention are disclosed in the subsequent dependent claims.

Figure 2:
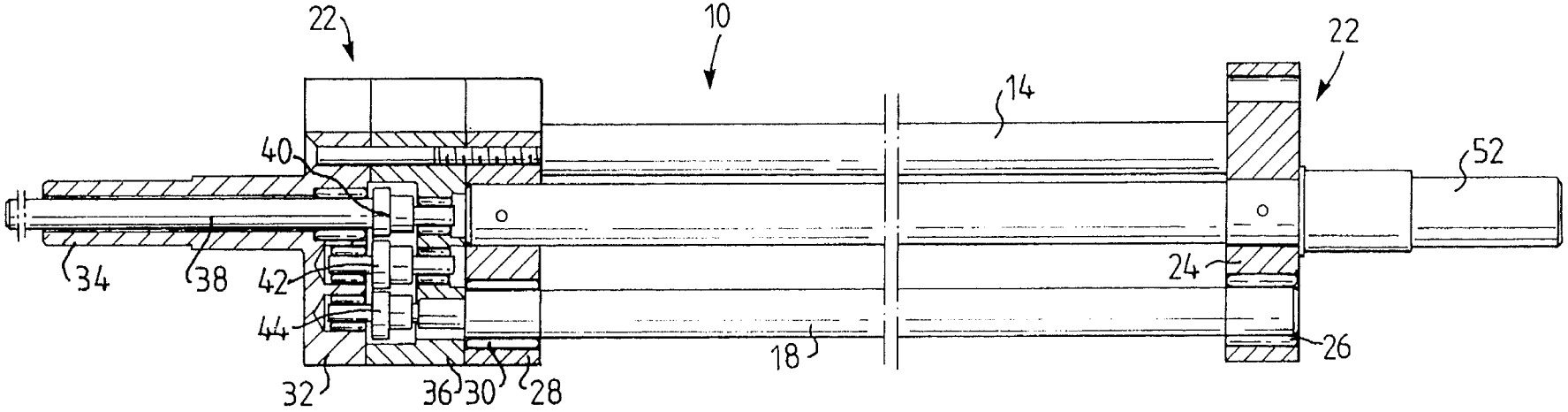

The invention will now be described in more detail below with reference to the accompanying drawings, where FIGS. 1A–1F show schematically a rolling device according to the invention in end view in different operating phases for rolling a wrapper onto a cigar body, and FIG. 2 is a section side view of the lower roll unit in a rolling device.

As can be seen in FIGS. 1A–1F, the device for rolling a wrapper onto a cigar body comprises a lower roll unit 10 and an upper roll unit 12. The lower roll unit 10 comprises four identical rolls 14, 16, 18, 20, which are mounted in a common holder 22 and are rotatably mounted about their own centre axes.

FIG. 2 shows in more detail how the lower roll unit 10 is constructed. The holder 22 at the right hand end of the roll unit 10 in FIG. 2 consists of an end piece 24 with four evenly distributed holes about a common circle for housing needle bearings 26 for each roll end. The holder 22 at the left-hand end as shown in FIG. 2 comprises firstly, an inner end piece 28, which, as does the right hand end piece 24, has corresponding holes for needle bearings 30 for rotating support of the opposite end of each of the rolls 14, 16, 18, 20, secondly, an outer end piece 32 from which a hub 34 extends and, thirdly, an intermediate piece between the inner and the outer end pieces 28 and 32, respectively.

A drive shaft 38 extends through the hub 34, the inner end of the drive shaft being journalled in the intermediate piece 36 and supporting a central gear 40, which via intermediate gears 42 in the outer end piece 32 and the intermediate piece 36 drive respective gears 44 at the ends of each roll 14, 16, 18, 20. As the drive shaft 38 rotates, all four rolls will rotate in unison in the same direction.

The holders 22 are furthermore rotatable in 90° steps about their own centre axis by means of a step feed device (not shown) which will be described in more detail below. The holders 22 can also be raised and lowered in a machine frame (not shown) in order to move the lower roll unit 10 away from or towards the upper roll unit 12 during a switching phase in the rolling operation, as will be described below.

A can be seen in FIG. 1A, the upper roll unit 12 comprises a pair of upper rolls 46, 48, which are rotatably mounted in the same horizontal plane. They are both driven in the same rotational direction as the rolls 14, 16, 18, 20 in the lower roll unit 10 and have the same peripheral speed as they.

The rolling apparatus according to the invention further comprises a feeding means 50 for cigar bodies, which are to be wrapped with a wrapper for making finished cigars. A dock 54 pivotably mounted on the end hubs 34 and 52 of the lower roll unit 10 is disposed to receive and carry a cigar body b delivered from the feed means 50 for wrapping (FIG. 1A).

The working principle of the roll device according to the invention will now be described with reference to FIGS. 1A–1F.

In the position shown in FIG. 1A, a wrapper is being rolled onto a cigar body a which has been laid between the rolls 46, 48 of the upper roll unit 12 and the two upper rolls 14, 16 of the lower roll unit 10. The rolls 46, 48, 14, 16 thus are in contact with the cigar body a and rotated at a rotational speed which is suitable for rolling on the wrapper. The wrapper is supplied to the rolling apparatus by means of a vacuum conveyor (not shown), one end of the wrapper being pressed down against the body a by means of a wrapper needle (not shown), which follows the wrapper rolling onto the body a about 1.5 turns, whereafter it is retracted. The wrapper is thus wrapped helically about the cigar body a, at varying speeds at the ends and the centre portion of the cigar body a. A pressing means (not shown) is inserted between the rollers and presses the wrapper to secure it at the cigar tip.

During the ongoing rolling phase shown in FIG. 1A, the feeding means 50 advances a new body b, which is received by the dock 54 in a position next to the roll 16, 18, which lie one above the other.

When the body a has been wrapped to produce a cigar, the entire lower roll unit 10 is moved downwards, as shown in FIG. 1B, and there is also initiated a 90° counterclockwise rotation of the lower roll unit 10 about the centre axis of the holders 22, as shown in FIG. 1C. The roll unit 10 brings with it the dock 54 in its 90° rotation so that the new cigar body b is brought into rolling contact with the rolls 16, 18. At the same time the finished cigar C falls down onto an exit conveyor (not shown) as indicated in FIG. 1D, where the roll unit 10 has assumed a position located 90° from the rolling position in FIG. 1A, so that the rolls 16, 18 now form the upper active pair of rolls in the lower roll unit 10.

The lower roll unit is then displaced upwards at the same time as the dock 54 is swung back to its horizontal position (FIG. 1E) to again receive a cigar body c from the feeding means 50, as is shown in FIG. 1F, where a new wrapper is wrapped about the body b.

After the cigar body b has been wrapped, the phases are repeated which were described above in connection with FIGS. 1B–1F.

By feeding out the finished cigar and feeding in a cigar body at the same time in the device according to the present invention, productivity can be doubled in comparison with the known device described by way of introduction.

Even if the described preferred embodiment of the invention comprises four rolls, it is to be understood that an increased number of rolls is conceivable within the scope of the invention.

I claim:

1. In a device for rolling wrappers onto cigar bodies, comprising a lower roller unit (10) with a first pair of parallel rolls (14, 16) lying in a horizontal plane and rotatable in the same direction about their own axes for supporting contact with a lower half of a cigar body when a wrapper is rolled thereon, said rolls being mounted in a holder (22) at either end of the rolls, and an upper roll unit (12) with two parallel rolls (46, 48) rotatable in the same direction about their own axes, and which, when the wrapper is rolled on, are disposed in a horizontal plane above and parallel to the rolls in the lower roll unit (10) in counteracting contact against an upper half of a cigar body; the improvement wherein the lower roll unit (10) comprises at least two additional rolls (18, 20), which are mounted in the same holders (22) as said first pair of rolls (14, 16) in the lower roll unit, and rotatable about their own axes in the same direction as said first pair, the holders (22) being rotatable about their central axis in 90° steps to always present two of its rolls in an upper position beside each other, and the upper and lower roll units (10, 12) being movable towards and away from each other.

2. Device according to claim 1, wherein the rolls (14, 16, 18, 20) in the lower roll unit (10) are identical and are mounted equiangularly spaced about a common circle, the centre of which coincides with the rotational axis of the holders (22).

3. Device according to claim 1, further comprising a swingable dock (54) coupled to the lower roll unit (10) and disposed to receive and carry a deposited cigar body (a, b, c) which is to be wrapped with a wrapper, in an area in front of a gap between two rolls (16, 18; 18, 20) lying vertically one on top of the other in the lower roll unit (10).

4. Device according to claim 1, wherein the lower roll unit (10) is vertically moveable relative to the upper roll unit (12).

5. Device according to claim 1, wherein the axes of the rolls of the upper roll unit (12) are fixed.

6. Device according to claim 1, wherein the holder (22) at one end of the rolls of the lower roll unit (10) comprises a transmission (40, 42, 44) for uniform rotation in unison of the four rolls (14, 16, 18, 20) of the unit.

7. Device according to claim 1, wherein the lower roll unit (10) is coordinated with a step feed unit for rotating the lower roll unit in 90° increments during the separation of the roll units (10, 12) from each other.

8. Device according to claim 3, further comprising a feeding conveyor (50) for cigar bodies (a, b, c) disposed to deposit a new cigar body on the dock (54).

9. Device according to claim 1, further comprising a drive unit for the device in the form of differential gearing for varying the rotational speed of the rolls (14, 16, 18, 20) during the rolling operation.

* * * * *